United States Patent [19]

Poovey

[11] Patent Number: 4,523,342

[45] Date of Patent: Jun. 18, 1985

[54] FOLDING BED FRAME STRUCTURE FOR SOFA BEDS OR THE LIKE

[75] Inventor: Homer F. Poovey, Newton, N.C.

[73] Assignee: Hickory Springs Manufacturing Company, Hickory, N.C.

[21] Appl. No.: 492,898

[22] Filed: May 9, 1983

[51] Int. Cl.[3] ..... A47C 23/02

[52] U.S. Cl. ..... 5/250; 5/13; 5/28; 5/12 R

[58] Field of Search ..... 5/12 R, 13, 28, 29, 5/44 R, 41, 42, 48, 247, 249, 250; 297/108, 456

[56] References Cited

U.S. PATENT DOCUMENTS

| | | | |
|---|---|---|---|
| 2,241,552 | 5/1941 | Hopkes | 5/247 |
| 3,002,198 | 10/1961 | Kaiser | 5/41 |
| 3,237,213 | 3/1966 | Birgbauer, Sr. | 5/13 |
| 3,258,786 | 7/1966 | Rea | 5/13 |
| 4,104,745 | 8/1978 | Pacitti | 5/13 |

FOREIGN PATENT DOCUMENTS

| | | | |
|---|---|---|---|
| 511908 | 6/1955 | Italy | 5/42 |

*Primary Examiner*—Gary L. Smith
*Assistant Examiner*—Michael F. Trettel
*Attorney, Agent, or Firm*—Richards, Shefte & Pinckney

[57] ABSTRACT

A folding sofa bed frame structure including four bed sections pivotally connected end-to-end and an operatively associated linkage arrangement by which the bed sections are mounted and which controls their relative movement between a retracted, folded position and a horizontally extended position. The forwardmost end bed section in the extended position folds to be horizontally uppermost in the folded position and includes spaced fixed cross-members which move pivotably therewith and between which a sinuous spring fabric assembly extends to provide strong, firm seating support in the folded position of the bed frame structure.

9 Claims, 6 Drawing Figures

FOLDING BED FRAME STRUCTURE FOR SOFA BEDS OR THE LIKE

BACKGROUND OF THE INVENTION

The present invention relates generally to folding bed frame structures of the type utilized in sofa beds or the like and more particularly relates to spring support arrangements employed therein for seating and sleeping support.

Convertible sofa beds having widely varying types of folding bed frame structures are in common use. The folding bed frames of such sofa beds characteristically employ a plurality of frame sections pivotally connected in end-to-end relation in combination with a linkage arrangement operatively associated with the frame sections for mounting of the structure within the rectangular enclosure of a sofa bed frame and for controlling the folding and unfolding movements of the frame sections between a retracted condition folded within the sofa frame enclosure and a horizontally extended condition extending outwardly therefrom. A wire and spring link-type support fabric or deck is typically provided across the longitudinal and transverse extents of the frame sections on which is supported a matress of relatively small thickness, the link-type fabric and the matress being readily foldable and thereby facilitating the necessary folding and unfolding movements of the folding bed frame structure. As will thus be understood, the link-type fabric and the matress provided substantially the only means of support for seating in the folded condition of the structure and for sleeping in the extended condition of the structure. For this reason, sofa bed structures of this general type are generally recognized to provide inferior seating comfort in the folded condition making the sofa beds in which they are used relatively undesirable if to be used for seating purposes primarily. Nevertheless, such sofa beds have achieved a relatively wide degree of popularity due primarily to the flexibility and versatility they lend in providing both a seating and a sleeping function.

In contrast, the present invention provides a novel improvement in sofa bed frame structures of the above-discussed type which advantageously permits incorporation into one frame section of the structure of sinuous-type springs such as are used conventionally in ordinary, non-convertible sofa furniture, whereby substantially greater and more comfortable seating support is provided in the present sofa bed frame structure without impairing the ordinary and desirable folding and unfolding operation of the structure.

SUMMARY OF THE INVENTION

Briefly described, the folding bed frame structure of the present invention includes a plurality of bed sections pivotally connected in end-to-end relation and a linkage arrangement adapted for affixation to a sofa frame or the like and operatively associated with the bed sections for supporting them on the frame and controlling relative movement of them in a predetermined pattern between a retracted position in which the bed sections are folded within the frame relative to one another with one bed section disposed uppermost in horizontal disposition for user seating thereon and an extended position in which the bed sections are horizontally aligned for user sleeping thereon. This one bed section has two cross-members extending transversely thereof and fixed thereto at each longitudinal end to be movable with the bed section in folding and unfolding movement. A sinuous spring fabric arrangement is affixed to each cross-member to extend longitudinally therebetween and across the one bed section for providing firm resilient seating support in the retracted position and firm resilient sleeping support in the extended position.

In the preferred embodiment, the plurality of bed sections includes a rear end section, a first intermediate section pivotally connected to the rear end section and a second intermediate section pivotally connected to the first intermediate section, the aforesaid one bed section being a forward end section pivotally connected to the second intermediate section. The linkage means is adapted for folding the bed sections in the retracted position with the rear end section in an upstanding disposition, with the first intermediate section extending forwardly from the rear end section, with the second intermediate section extending upwardly from the first intermediate section and with the forward end section extending rearwardly from the second intermediate section toward the rear end section in spaced superposed parallel relation to the first intermediate section. The second intermediate section includes a cross-member extending transversely thereof and fixed thereto generally along its pivot axis with the forward end section to be movable with the second intermediate section. One cross-member of the forward end section extends transversely thereof immediately adjacent and generally parallel to the cross-member of the second intermediate section. The sinuous spring fabric arrangement is curved in its extent longitudinally and outwardly of the forward end section to be generally convex in the retracted position for enhanced firmness and strength of seating support. Preferably, the sinuous spring fabric arrangement includes a plurality of sinuous spring elements each being a length of spring wire or strand generally in the form of a sinusoidal curve and each affixed at its opposite ends respectively to the cross-members of the forward end section. A plurality of transverse connecting members extend transversely of and are affixed respectively to the sinuous spring elements. A conventional link-type fabric is affixed to the rear end and the first and second intermediate sections to extend therealong and thereacross.

DESCRIPTION OF THE PREFERRED EMBODIMENT

Figure 1:
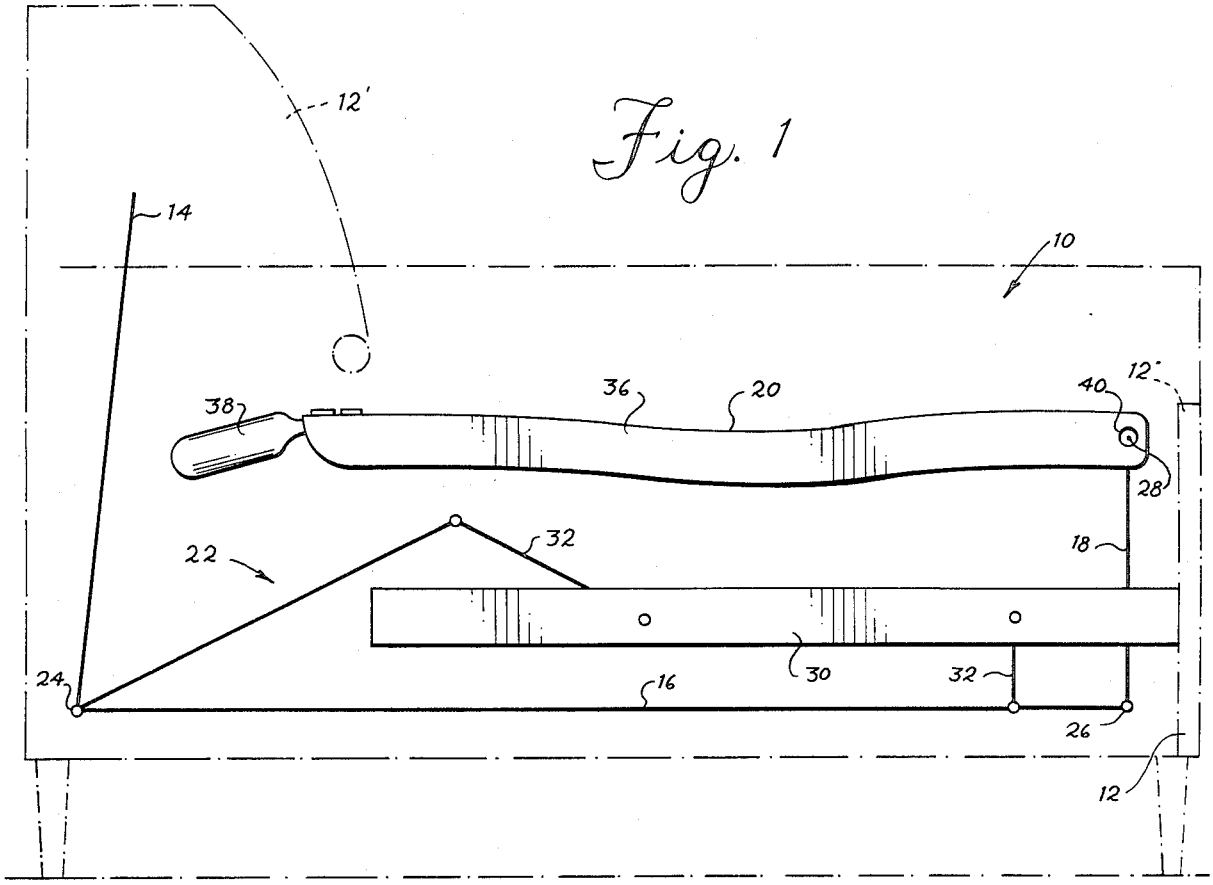
FIG. 1 is a side elevational view of an end portion of a sofa bed in which is mounted a folding bed frame structure according to the preferred embodiment of the present invention showing it in its retracted position.
Figure 2:
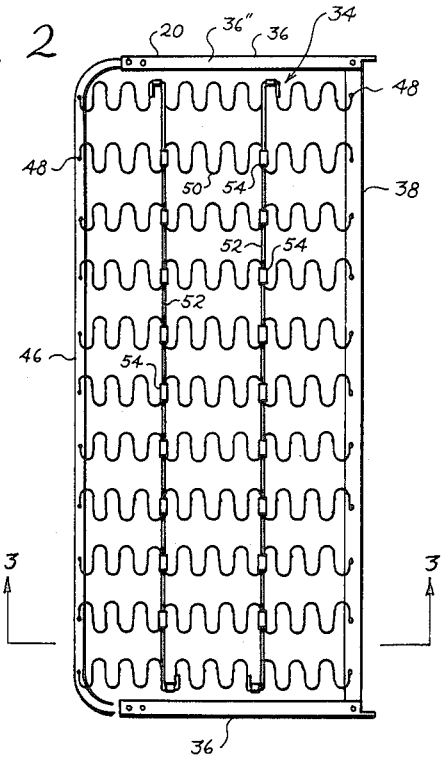
FIG. 2 is a top plan view of the sofa bed and bed frame structure of FIG. 1.
Figure 3:
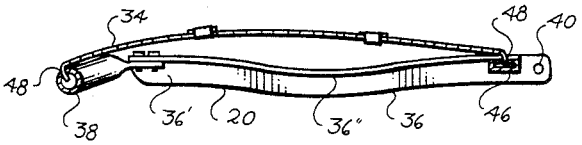
FIG. 3 is a vertical sectional view of the forward end section of the folding bed frame structure of FIGS. 1 and 2 taken along line 3—3 of FIG. 2.

Referring now to the accompanying drawings, the folding bed frame structure of the present invention is generally indicated at 10 in FIG. 1 and is illustrated in the preferred embodiment thereof in a sofa frame 12 of conventional construction. The sofa frame 12 forms no part of the present invention and therefore is illustrated schematically and in phantom lines in the accompanying drawings.

The folding bed frame structure 10 basically includes four bed frame sections 14, 16, 18, 20 pivotally connected in end-to-end relation and a linkage arrangement generally indicated at 22 adapted for affixation interiorly to the sofa frame 12 and operably associated with the bed sections 14, 16, 18, 20 for supporting them on the sofa frame 12 and articulably actuating and controlling pivotal movement of the bed sections 14, 16, 18, 20 in a predetermined pattern between a rearwardly retracted position in which the bed sections 14, 16, 18, 20 are folded relative to one another within the enclosure of the sofa frame 12 and a forwardly extended position in which the bed sections 14, 16, 18, 20 are horizontally aligned.

As used herein, the terms "forward", "rearward", and "intermediate" define positions of the folding bed frame structure 10 relative to the sofa frame 12 and the manner in which the bedframe structure 10 is adapted to be relatively disposed therewithin, "foward" being the direction from the upright seat back 12' of the sofa frame 12 toward the front rail 12'' thereof and "rearward" being the opposite direction.

As more fully discussed hereinafter, the present invention resides primarily in the construction of the forward end bed section 20 and in its operative pivotal relationship with the adjacent intermediate bed section 18. The particular construction of the other bed sections and of the linkage arrangement 22 are not critical and may be of a wide variety of conventional forms. Accordingly, for sake of simplicity and clarity of illustration, description and understanding of the present invention, the bed sections 14, 16, 18 and the linkage arrangement 22 have been illustrated only schematically and representively by straight lines in "stick-figure" fashion. To the extent of the bed sections 14, 16, 18 and the linkage arrangement 22, the illustrated bed frame structure 10 is of generally the same conventional type as illustrated and described in Rogers, Jr. U.S. Pat. No. 3,284,811; Mikos U.S. Pat. No. 3,516,096; and Mikos U.S. Pat. No. 4,253,205, to which reference may be had as to particular constructions representative of the bed sections 14, 16, 18 and the linkage arrangement 22.

As will be understood, the folding bed frame structure 10 extends between the end frame members of the sofa frame 12 substantially the width thereof and includes identical bed section and linkage components at each side joined for simultaneous identical movement in conventional manner by cross-members which extend between corresponding bed section components transversely of the forward-rearward extent of the bed sections. Thus, in the side elevational views of FIGS. 1 and 4, only the components at one side of the bed frame structure 10 are illustrated and herein described.

Figure 4:
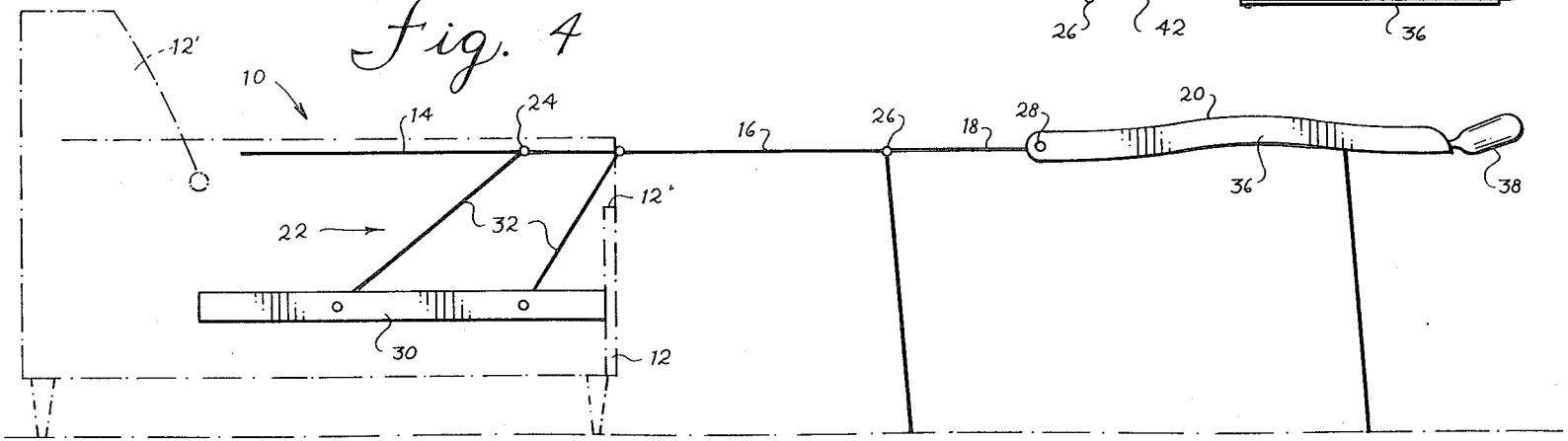
FIG. 4 is another side elevational view of the end portion of the sofa bed of FIG. 1 illustrating it in its fully extended position.

Referring now in greater detail to the bed frame structure 10 of FIGS. 1 and 4, the bed sections 14, 16, 18, 20 include a rear end or head support section 14 one end of which is free and unsupported and the other end of which is pivotally connected at 24 to an end of a first intermediate section 16 which forms the main body supporting section of the bed sections. The main intermediate section 16 is pivotably connected at its other end at 26 to an end of a second intermediate section 18, which is pivotally connected at its other end at 28 to an end of a forward end or foot support section 20 the other end of which is free and unsupported. As is conventional, each bed section 14, 16, 18, 20 is formed of opposed side rails formed as angle members connected by transverse cross-members.

The linkage arrangement 22 basically includes a support linkage arrangement for supporting the bed sections 14, 16, 18, 20 on the sofa frame 12 through their movement between their folded and extended positions and an actuating and control linkage arrangement associated with the support linkage for transmitting folding and unfolding movement to the bed sections 14, 16, 18, 20. In the accompanying drawings, the support linkage is representatively illustrated by a horizontal support bracket 30 adapted for affixation interiorly to the side frame members of the sofa frame 12 and support links 32 pivotably affixed at a horizontal spacing to the support bracket 30. The actuating and control linkage is not shown in the drawings. Conventionally, the actuating and control linkage is pivotably affixed to the free ends of the support links 32 and to the bed sections 14, 16, 18, 20 for constraining the bed sections to fold and unfold in a predetermined pattern. In the drawings, the support links 32 are shown as connected to the bed sections 14, 16, in representative fashion and in representation of the operative connection therebetween provided by the actuating and control linkage. As will be understood, the supporting linkage and the actuating and control linkage are cooperatively arranged in conventional manner to cause the bed sections 14, 16, 18, 20 to fold relative to one another within the sofa frame 12 with the rear end section 14 in an upstanding disposition extending upwardly within the hollow sofa seat back 12', with the main intermediate section 16 extending forwardly from the rear end section 14 in a generally horizontal disposition, with the second intermediate section 18 extending upwardly from the main intermediate section 16 and with the forward end section 20 extending rearwardly from the second intermediate section 18 toward the rear end section 14 in spaced, superposed, substantially parallel relation to the main intermediate section 16, as schematically illustrated in FIG. 1, and to cause the bed sections 14, 16, 18, 20 to articulably unfold from such folded disposition around the seat back 12' and upwardly and forwardly from the sofa frame 12 to the horizontally aligned extended position of FIG. 4.

Importantly, it is to be noted that the linkage arrangement 22 and the bed sections 14, 16, 18, 20 are cooperative to dispose the forward end section 20 uppermost in a horizontal disposition in the folded condition. In such disposition, the forward end section 20 provides a support surface for sofa seat cushions (not shown) and, in conjunction with the matress (not shown) folded there beneath, provides substantially all of the support for such seat cushions and for user seating thereon. In contrast, in the fully extended condition of the bed frame structure 10, the forward end section 20 is disposed for supporting only a user's lower legs and feet during sleeping. Thus, in the two differing conditions of use of the bed frame structure, the forward end section 20 must be capable of performing two very different support functions requiring greatly differing degrees of strength and firmness. As previously noted, the conventional link-type wire and spring support fabric employed traditionally in sofa bed frame structures of the above-described type are generally incapable of providing the strength and firmness of support required in the folded condition of the structure for comfortable firm support for user seating. The present invention provides an improved spring support arrangement for the forward end section 20 which is sufficiently strong and firm to provide substantially greater user seating support than is provided by conventional link-type fabric and which is substantially comparable to the support provided by conventional non-covertible sofa furniture.

Figure 5:
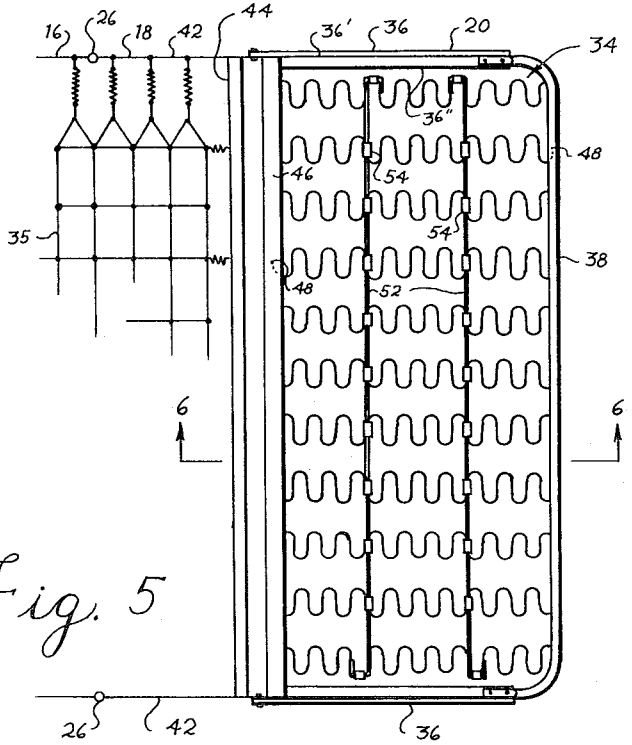
FIG. 5 is a top plan view of the first and second intermediate sections and the forward end section of the bed frame structure of FIG. 4.
Figure 6:
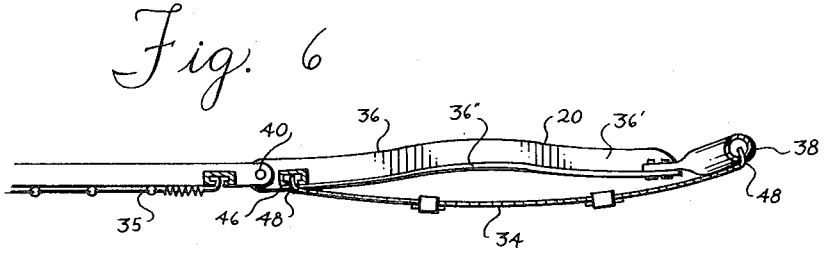
FIG. 6 is a vertical sectional view of the forward end section of the bed frame structure of FIGS. 4 and 5 taken along line 6—6 of FIG. 5.

Referring now to FIGS. 2–3 and 5–6, the novel spring support arrangement of the forward end section 20 is shown generally at 34 and basically constitutes a sinuous spring fabric assembly affixed to the framework of the forward end section 20. As previously indicated, the framework of the forward end section 20 includes spaced angle members 36 which form the side rails of such framework and a U-shaped cross-member 38 extending transversely between and fixed to the forwardmost free ends of the angle members 36. As is conventional, the rearwardmost ends of the angle members 36 have suitable openings 40 formed in their vertical legs 36' by which the forward end section 20 is pivotably connected to the forwardmost ends of the side rail angle members 42 of the second intermediate section 18 which angle members have similar and correspondingly formed openings therein. Conventionally, a cross-member is affixed to the intermediate section angle members 42 at some location thereon to extend transversely therebetween but no such cross-member other than cross-member 38 is conventionally provided on the forward end section 20. According to the present invention, the intermediate section 18 has a cross-member 44 affixed to its angle members 42 immediately adjacent the pivotal connection of the intermediate section 18 with the forward end section 20 so as to extend between the forwardmost ends of the angle members 42 generally along the pivot axis between the bed sections 18, 20. In conventional manner, a link-type spring and wire fabric, indicated generally at 46 in FIG. 5, is affixed to and extends transversely between the angle members 42 of the intermediate section 18 as well as between the corresponding angle members (not shown) of the rear end section 14 and the main intermediate section 16 and is also affixed to and extends longitudinally between the cross-member 44 of the intermediate section 18 and a U-shaped cross-member (not shown) at the rearwardmost end of the rear end section 14.

The forward end section 20 is provided with a cross-member 46 affixed to and extending between the horizontal legs 36'' of the angle members 36 adjacent their rearwardmost ends. In this manner, the cross-member 46 is arranged to be pivotably movable with the forward end section 20. The two cross-members 38, 46 of the forward end section are provided respectively with plural openings 48 spaced along their lengths in the sides thereof which face upwardly in the horizontal disposition of the forward end section 20 in the folded condition of the bed frame structure 10. A plurality of sinuous spring elements 50, each being a length of spring wire or other spring strand generally in the form of a planar sinusoidal curve, and are arranged to extend longitudinally of the forward end section 20 generally planarly therewith with the opposite ends of each such spring element 50 being inserted in respective longitudinally aligned openings 48 in the cross-members 38, 46 and bent angularly relative to the spring element's planar extent to retain the spring elements 50 in their described dispositions. At least two connecting members 52 formed of spring wire or cable are arranged to extend generally perpendicularly to the sinuous spring elements 50 transversely of the forward end section 20 generally parallel with its cross-members 38, 46 at generally equal spacings from such cross-members 38, 46 and from each other and the connecting members 52 are affixed by band clamps 54 to each such sinuous spring element 50, thereby to rigidify and retain the spring elements 50 in their disposition generally coplanar with the forward end section 20. Preferably, the sinuous spring elements 50 are slightly bowed in their longitudinal extent to be slightly convexly curved outwardly from the sides of the cross-members 38, 46 to which the spring elements 50 are affixed, whereby the spring elements 50 are slightly convex in the horizontal disposition of the forward end section 20 in the folded condition of the bed frame structure 10.

In the operation of the bed frame structure 10, it will thus be understood that, in the folded condition of the structure 10, the sinuous spring fabric assembly 34 provides a significantly stronger and firmer degree of support for user seating on the folded structure 10 than do conventional link-type fabric arrangements. The convex nature of the sinuous spring fabric assembly 34 provides a degree of flexure to the assembly 34 which lends resiliency to the assembly 34 and provides a comfortable feel in seating use. In contrast to conventional bed frame structures utilizing link-type fabric wherein the folded mattress provides most of the user seating support, the framework itself of the present bed frame structure 10, particularly the forward end section 20 thereof, primarily provides user seating support with the mattress providing only supplementary cushioning support. In the fully extended condition of the bed frame structure 10, the forward end section 20 functions in ordinary manner for foot and leg support in sleeping use. Importantly, the arrangement of the present invention for use of the sinuous spring fabric assembly 34 is accomplished without modification of the linkage arrangement 22 and without significant modification of the framework structure of the bed sections 14, 16, 18, 20, whereby the present invention may be readily adapted to be used in a wide number of conventional bed frame structures 10.

The present invention has been described in detail above for purposes of illustration only and is not intended to be limited by this description or otherwise to exclude any variation or equivalent arrangement that would be apparent from, or reasonably suggested by the foregoing disclosure to the skill of the art.

I claim:

1. A folding bed frame structure for sofa beds or the like comprising a plurality of bed sections pivotally connected in end-to-end relation and linkage means adapted for affixation to a sofa frame or the like and operably associated with said bed sections for supporting said bed sections on said frame and controlling relative movement thereof in a predetermined pattern between a retracted position in which said bed sections are folded within said frame relative to one another with one said bed section disposed uppermost in horizontal disposition for user seating thereon and an extended position in which said bed sections are horizontally aligned for user sleeping thereon, non-sinuous link fabric means extending along and across each said bed section except said one bed section for providing firm resilient sleeping support in said extended position, said one bed section having two cross-members extending transversely thereof and fixed thereto at each longitudinal end thereof to be movable with said one bed section, and sinuous spring fabric means affixed to each said cross-member to extend longitudinally therebetween and across said one bed section for providing firm resilient seating support in said retracted position and firm resilient sleeping support in said extended position, said sinuous spring fabric means being curved in its extent longitudinally and outwardly of said one bed section to be generally convex in said retracted position for enhanced firmness and strength of seating support.

2. A folding bed frame structure according to claim 1 and characterized further in that said sinuous spring fabric means includes a plurality of sinuous spring elements each being a length of spring strand generally in the form of a sinusoidal curve and each affixed at its opposite ends respectively to said cross-members, and further includes a plurality of transverse connecting members extending transversely of and affixed respectively to said sinuous spring elements.

3. A folding bed frame structure according to claim 2 and characterized further in that said one bed section is an end section and said plurality of bed sections includes an adjacent section pivotally connected to said end section, said adjacent section having a cross-member extending transversely thereof and fixed thereto generally along its pivot axis with said end section to be movable with said adjacent section, said link fabric means being affixed to said adjacent section and to its said cross member to extend therealong and thereacross.

4. A folding bed frame structure according to claim 3 and characterized further in that said bed sections include a rear end section, a first intermediate section pivotally connected to said rear end section and a second intermediate section pivotally connected to said first intermediate section, said one bed section being a forward end section pivotally connected to said second intermediate section, said linkage means being adapted for folding said bed sections in said retracted position with said rear end section in an upstanding disposition, with said first intermediate section extending forwardly from said rear end section, with said second intermediate section extending upwardly from said first intermediate section and with said forward end section extending rearwardly from said second intermediate section toward said rear end section in spaced superposed parallel relation to said first intermediate section.

5. A folding bed frame structure according to claim 2 and characterized further in that said bed sections include a rear end section, a first intermediate section pivotally connected to said rear end section and a second intermediate section pivotally connected to said first intermediate section, said one bed section being a forward end section pivotally connected to said second intermediate section, said linkage means being adapted for folding said bed sections in said retracted position with said rear end section in an upstanding disposition, with said first intermediate section extending forwardly from said rear end section, with said second intermediate section extending upwardly from said first intermediate section and with said forward end section extending rearwardly from said second intermediate section toward said rear end section in spaced superposed parallel relation to said first intermediate section.

6. A folding bed frame structure according to claim 1 and characterized further in that said one bed section is an end section and said plurality of bed sections includes an adjacent section pivotally connected to said end section, said adjacent section having a cross-member extending transversely thereof and fixed thereto generally along its pivot axis with said end section to be movable with said adjacent section, said link fabric means being affixed to said adjacent section and to its said cross member to extend therealong and thereacross.

7. A folding bed frame structure according to claim 6 and characterized further in that said bed sections include a rear end section, a first intermediate section pivotally connected to said rear end section and a second intermediate section pivotally connected to said first intermediate section, said one bed section being a forward end section pivotally connected to said second intermediate section, said linkage means being adapted for folding said bed sections in said retracted position with said rear end section in an upstanding disposition, with said first intermediate section extending forwardly from said rear end section, with said second intermediate section extending upwardly from said first intermediate section and with said forward end section extending rearwardly from said second intermediate section toward said rear end section in spaced superposed parallel relation to said first intermediate section.

8. A folding bed frame structure according to claim 1 and characterized further in that said bed sections include a rear end section, a first intermediate section pivotally connected to said rear end section and a second intermediate section pivotally connected to said first intermediate section, said one bed section being a forward end section pivotally connected to said second intermediate section, said linkage means being adapted for folding said bed sections in said retracted position with said rear end section in an upstanding disposition, with said first intermediate section extending forwardly from said rear end section, with said second intermediate section extending upwardly from said first intermediate section and with said forward end section extending rearwardly from said second intermediate section toward said rear end section in spaced superposed parallel relation to said first intermediate section.

9. A folding bed frame structure for sofa beds or the like comprising a plurality of bed sections pivotally connected in end-to-end relation, said bed sections including an end section and an adjacent section pivotally connected to said end section, and linkage means adapted for affixation to a sofa frame or the like and operably associated with said bed sections for supporting said bed sections on said frame and controlling relative movement of the bed sections in a predetermined pattern between a retracted position in which said bed sections are folded within said frame relative to one another with said end section disposed uppermost in horizontal disposition for user seating thereon and an extended position in which said bed sections are horizontally aligned for user sleeping thereon, said adjacent section including a first fixed cross-member extending transversely thereof generally along its pivot axis with said end section to be movable with said adjacent section, said adjacent section and each other said bed section except said end section including non-sinuous link fabric means affixed thereto and to said first cross-member to extend along and across said adjacent and other bed sections for providing firm resilient sleeping support in said extended position, said end section including a second fixed cross-member extending transversely thereof immediately adjacent and generally parallel to said first fixed cross-member to be movable with said end section and said end section including sinuous spring fabric means affixed thereto and to said second fixed cross-member to extend along and across said end section for providing resilient seating support in said retracted position and firm resilient sleeping support in said extended position, said sinuous spring fabric means being curved in its extent longitudinally and outwardly of said one bed section to be generally convex in said retracted position for enhanced firmness and strength of seating support.

* * * * *